United States Patent [19]

Ward

[11] 4,013,737

[45] Mar. 22, 1977

[54] UPGRADING SYNTHETIC GASOLINE

[75] Inventor: Dennis J. Ward, South Barrington, Ill.

[73] Assignee: Universal Oil Products Company, Des Plaines, Ill.

[22] Filed: June 16, 1975

[21] Appl. No.: 587,467

[52] U.S. Cl. ..... 260/683.2; 208/134; 260/449 R; 260/450

[51] Int. Cl.[2] ..... C07C 5/24

[58] Field of Search ..... 208/134; 260/683.2, 260/449, 450

[56] References Cited

UNITED STATES PATENTS

| | | | |
|---|---|---|---|
| 2,018,065 | 10/1935 | Ipatieff | 260/683.2 |
| 2,199,133 | 4/1940 | Marschner | 260/683.2 |
| 2,294,696 | 9/1942 | Schmitkons | 260/683.2 |
| 2,516,699 | 7/1950 | Hemminger | 260/450 |
| 2,556,275 | 6/1951 | Hemminger | 260/450 |
| 2,754,314 | 7/1956 | McGrath | 260/449 R |

*Primary Examiner*—Veronica O'Keefe
*Attorney, Agent, or Firm*—James R. Hoatson, Jr.; Thomas K. McBride; William H. Page, II

[57] ABSTRACT

Gasoline synthesized from carbon monoxide and hydrogen is contacted with a solid phosphoric acid catalyst to improve the octane number of the gasoline.

7 Claims, 1 Drawing Figure

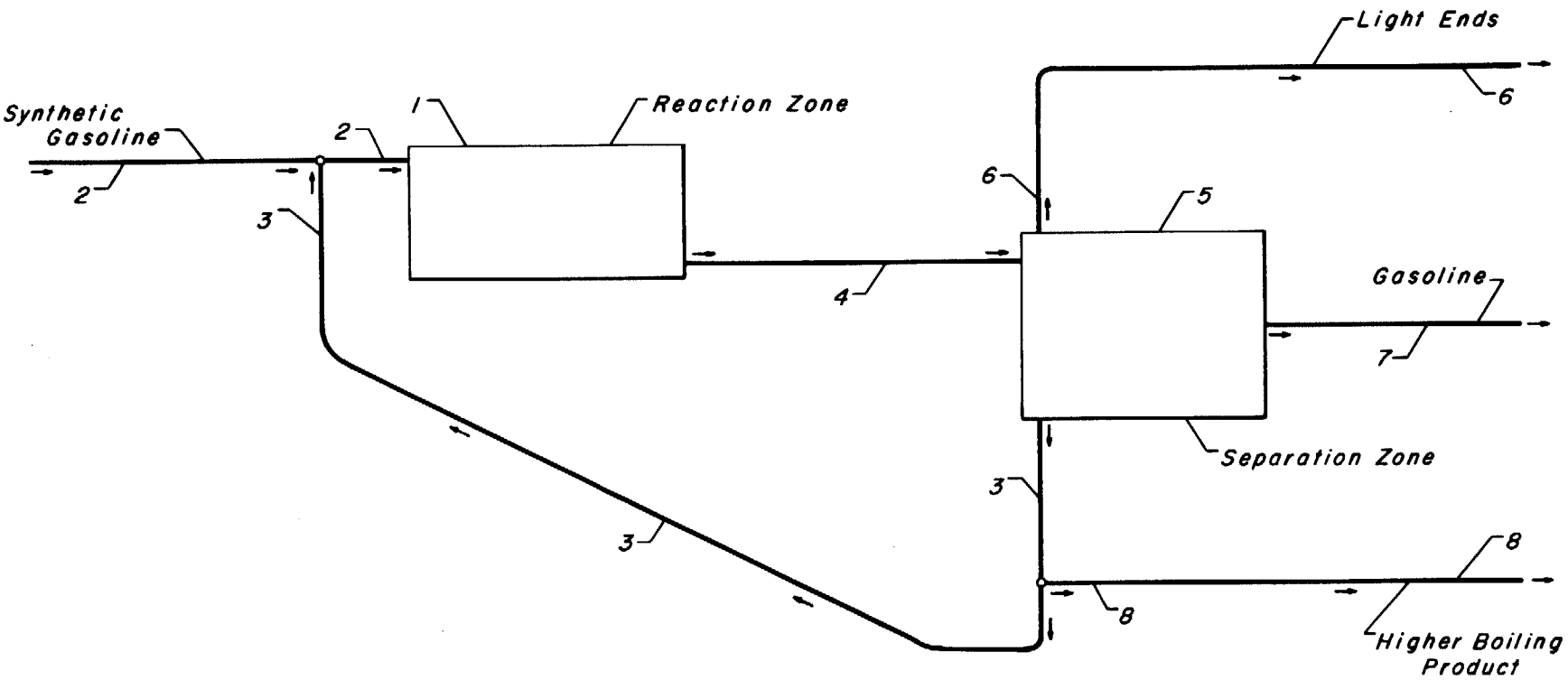
Light Ends
6
Gasoline
7
Separation Zone
5
8
Higher Boiling Product
8
6
3
4
Reaction Zone
1
3
2
3
Synthetic Gasoline
2

UPGRADING SYNTHETIC GASOLINE

BACKGROUND OF THE INVENTION

This invention relates to the catalytic reduction of carbon oxide with hydrogen and is more particularly concerned with octane improvement of synthetic gasoline resulting from the reaction of carbon oxide with hydrogen. The present invention further relates to the reaction of low octane, principally olefinic synthetic gasoline when it is contacted with solid phosphoric acid catalyst.

A production system of some interest today is the production of synthesis gas (carbon monoxide + hydrogen) from low grade fuels such as coal, and the synthesis of hydrocarbon constituents useful as motor fuels by the Fischer-Tropsch method. Synthesis gas may be obtained from coal, shale oil, petroleum, hydrocarbon gases, municipal refuse, or other carbonaceous material by reaction with steam over a catalyst or by partial direct oxidation using oxygen. For example, methane and steam react over a catalyst at a temperature of about 1400° F. to about 1500° F. in accordance with the reaction:

$$CH_4 + H_2O \rightarrow CO + 3\ H_2$$

whereas methane may be reacted directly with oxygen by the reaction:

$$CH_4 + \tfrac{1}{2}\ O_2 \rightarrow CO + 2\ H_2$$

Processes in which these reactions are conducted are in widespread use today, particularly in the manufacture of hydrogen. Mostly natural gas and naphtha are utilized as feedstocks in hydrogen manufacturing plants, but of growing interest in view of the present relatively high cost of petroleum and growing scarcity of natural gas, is the utilization of low grade fuels such as coal to produce a carbon oxide plus hydrogen gas mixture from which gasoline may be synthesized.

The Fischer-Tropsch reactions in which hydrocarbons are synthesized from mixtures of carbon oxide and hydrogen are well-known in the art. In addition to gasoline and diesel oil, carbon dioxide, steam, and oxygenated compounds such as acids, alcohols, aldehydes, and ketones are produced by the Fischer-Tropsch reaction. The primary reaction is:

$$n\ CO + 2n\ H_2 \rightarrow (CH_2)_n + n\ H_2O$$

This occurs in the temperature range 400° to 670° F., which is sufficiently high for the water-gas shift to take place in the presence of the catalyst:

$$CO + H_2O \rightleftharpoons CO_2 + H_2$$

and the overall reaction may be written:

$$n\ CO + n\ H_2 \rightarrow (CH_2)_n + n\ CO_2$$

By judicious control of the process operating variables including choice of catalyst, one may produce more or less of the above mentioned products. For example, in U.S. Pat. No. 2,510,096, a procedure is disclosed to provide an operation minimizing the effect of the water-gas shift reaction and to reduce if not eliminate production of $CO_2$ by regulating the $CO_2$ content of the reactant gas stream supplied to the catalyst at a value of at least 15 percent $CO_2$.

Several catalysts have been utilized in the Fischer-Tropsch reaction, but the ones of principal commercial value are those activated by cobalt and those activated by iron. Fischer-Tropsch synthesis of gasoline was conducted extensively in Germany during World War II utilizing a catalyst containing five parts thoria, eight parts magnesia, 100 parts cobalt, and 200 parts kieselguhr. Operating conditions included a temperature of about 400° to 430° F. and pressure of about 1 to 15 atmospheres. Most recent operations have utilized predominately an iron-catalyzed process operating at somewhat higher temperatures of about 550° F. to 700° F. and pressure of about 20 to 40 atmospheres. For production of hydrocarbons predominantly in the gasoline boiling range, a catalyst temperature of about 600° to 650° F. is usually requisite with an iron catalyst. Hydrocarbon products of both catalyst systemes are hydrogen deficient with olefins being the predominant product, especially in the iron-catalyzed process. As reported by Bruner, "Ind. Eng. Chem.," 42:2511 (1949), the following product distributions can be expected with these catalysts:

| | COBALT CATALYST | | IRON CATALYST | |
|---|---|---|---|---|
| | Wt.% of Total | Olefin Content, Vol.% | wt.% of Total | Olefin Content Vol.% |
| $C_3 + C_4$ | 10 | 40 | 32 | 82 |
| Naphtha | 30 | 26 | 56 | 85–90 |
| Diesel Fuel | 33 | 8 | 8 | 75–85 |
| Residue | 27 | — | 4 | — |

In addition to the generally more favorable product distribution of the iron catalyst, it has an additional advantage of being more flexible in regard to permissible hydrogen-carbon monoxide ratios. Whereas the cobalt promoted catalyst is somewhat limited to the stoichiometric hydrogen-carbon monoxide ratio of 1 to 2 for optimum results, suppression of carbon dioxide formation can be achieved whenever the iron catalyst is utilized by increasing this ratio, which is obtained by suitable recycling of hydrogen gas from the reaction zone effluent to the reaction zone inlet. Accordingly, it is advantageous to use feed gases which contain at least a 3 to 1 ratio of hydrogen to carbon monoxide, and preferably a ratio of 4 to 1 and higher.

A simplified flow scheme of a Fischer-Tropsch process known in the art includes a reaction zone wherein a powdered synthesis catalyst of the iron type is maintained in a state of dense phase fluidization by an upward flowing reactants stream with provision for rapid removal of the heat of reaction. The resulting reaction zone effluent is cooled, condensed, and separated to form a normally gaseous stream consisting of carbon dioxide, hydrogen, light gaseous hydrocarbons, and any unreacted carbon monoxide; a liquid hydrocarbon stream; and an aqueous stream. In addition to the hydrocarbon products, a broad range of oxygenated organic compounds are produced by the Fischer-Tropsch reaction. Generally speaking, the lower molecular weight oxygenated compounds of one to four carbon atoms, especially the alcohols, acids, and aldehydes, are recovered predominantly in the aqueous stream with only a small amount being present in the liquid hydrocarbons stream. While the lower molecular weight oxygenated compounds present in the liquid hydrocarbons stream may in general be recovered by water washing the hydrocarbons stream, considerable percentages of the propyl and higher alcohols are recovered in the liquid hydrocarbons stream. After water washing of the liquid hydrocarbon stream resulting from the synthesis operation, the oxygen content of that stream is about 0.1 weight percent to about 10 weight percent. The liquid hydrocarbons stream is generally further separated to produce a $C_3 + C_4$ fraction, a synthetic gasoline fraction, and a diesel fraction. The $C_3 + C_4$ fraction, being principally olefinic, may be further processed over a polymerization catalyst to result in a high octane gasoline product. The synthetic fraction, although characterized by a relatively low research octane number of about 62 to 65, nevertheless has generally been utilized as a gasoline blending component due to the difficulty in further processing the oxygenated compounds.

Bruner, "Ind. Eng. Chem.," 41:2511 (1949) shows the structure of the $C_6$ to $C_8$ hydrocarbons in a synthetic gasoline from an iron-catalyzed reaction as follows:

| | $C_6$ | $C_7$ | $C_8$ |
|---|---|---|---|
| n-hydrocarbons, wt. percent | 75.9 | 60.2 | 55.4 |
| monomethyl isomers, wt. percent | 20.0 | 29.3 | 36.6 |
| dimethyl isomers, wt. percent | 0.4 | 1.7 | 2.4 |
| cyclic isomers, wt. percent | 4.7 | 8.8 | 5.6 |

It may therefore be concluded that the low octane number of the synthetic gasoline is due to a relatively high straight-chain olefin content. In the case of a synthetic gasoline from a cobalt-catalyzed reaction, it is observed that the normal hydrocarbon content of the $C_6$ to $C_8$ fraction is about 15 to 20 weight percent higher than that of an iron-catalyzed synthetic gasoline, resulting in an even lower octane number.

Because of the relatively poor quality of a synthetic gasoline as a gasoline blending component, attempts have been made to isomerize the straight-chain olefins to higher octane branch-chain olefins. Various catalysts have been suggested in the art including an iron promoted catalyst, magnesium chromate/silica alumina, alumina activated with hydrochloric acid, activated clay, alumina activated with hydrogen fluoride, and others.

SUMMARY OF THE INVENTION

Accordingly, it is an object of this invention to provide a process for isomerizing the components of a synthetic gasoline to result in a more branched-chain components.

Further, it is an object of this invention to provide a process wherein an octane improvement of a synthetic gasoline is effected.

Another object of the present invention is to provide a process in which higher molecular weight components of a synthetic gasoline fraction are cracked and the resulting cracked products are polymerized to result in a high octane product suitable for gasoline blending.

A still further object of this invention is to provide a process wherein the $C_3 + C_4$ fraction and the gasoline fraction from a Fischer-Tropsch synthesis reaction are treated in admixture to result in a high octane gasoline product.

In the synthesis of hydrocarbons by the catalytic reduction of a carbon oxide with hydrogen to result in a relatively low octane olefin-containing $C_5$–$C_{14}$ hydrocarbon fraction, this invention relates in an embodiment to the process comprising contacting said hydrocarbon fraction with a solid phosphoric acid catalyst to result in a higher octane olefin-containing hydrocarbon product.

In essence, my invention provides a catalyst capable of increasing the octane number of a synthetic gasoline by isomerizing the principally low octane, straight-chain olefins of the synthetic gasoline to higher octane, branched-chain olefins. Additionally, the catalyst provided by my invention is capable of cracking hydrocarbons of higher molecular weight than are normally included in a synthetic gasoline and polymerizing the product, thereby resulting in increased synthetic gasoline yield from a Fischer-Tropsch synthesis reaction. Also, the catalyst provided by my invention has the capability of polymerizing $C_3$ and $C_4$ olefins to high octane, gasoline boiling range components and permits this polymerization reaction simultaneous with the isomerization, cracking, and polymerization reactions described hereinabove, thereby allowing the simultaneous processing of a synthetic gasoline fraction and a $C_3 + C_4$ olefin fraction in a single catalytic system.

Other objects, embodiments, and advantages of the present invention will be found in the following detailed description of the invention.

DESCRIPTION OF THE INVENTION

The attached drawing is a schematic illustration of one embodiment of the process of the present invention. The scope of the invention is not intended to be limited to the embodiment shown, and various other embodiments will be obvious to those skilled in the art from the description hereinafter provided.

Referring to the drawing, a gasoline synthesized from carbon oxide and hydrogen by the Fischer-Tropsch reaction is introduced into a reaction zone 1 by conduit 2. Also introduced into the reaction zone 1 via conduit 2 is a recycled portion of a higher molecular weight product of the present invention, prepared as described hereinbelow, which is recycled via conduit 3 and admixed with the synthetic gasoline feed-stock in conduit 2. The fresh feed gasoline introduced into the present process has a boiling range of about 110° F. to about 480° F. and contains $C_5$ to $C_{14}$ molecules which are principally straight-chain olefins. $C_3$ and $C_4$ olefinic products of the Fischer-Tropsch reaction, or $C_3$ and $C_4$ olefins available from other refining sources such as a fluid catalytic cracking process, a pyrolysis process, or a thermal cracking process may optionally also be included in the fresh feedstock. In reaction zone 1, the primary reaction is an isomerization reaction to rearrange the molecular structure of the $C_5$–$C_{14}$ straight-chain olefins to result in branched-chain olefins, but other reactions including cracking of the heavier portion of the feedstock ($C_{10}$ to $C_{14}$ molecules) and polymerization of the lighter portion of the feedstock ($C_3$ and $C_4$ molecules) is observed with the catalyst utilized, a solid phosphoric acid catalyst well known in the art and containing about 60 to 90 weight percent phosphoric acid. The catalyst system in reaction zone 1 includes a reactor vessel and a fixed catalyst bed with a flow path through the catalyst bed being either upwardly, downwardly, or radially. Flow distribution and redistribution means may be provided as may be reaction quenching means. While the heat of reaction of an isomerization reaction is relatively insignificant, substantial heat of reaction is generated if the fresh feedstock contains a substantial amount of the heavier ($C_{10}$ to $C_{14}$ molecules or a substantial amount of lighter ($C_3$ and $C_4$) molecules and cracking or polymerization reactions become significant. Quenching of the reaction by an inert stream such as a propane-rich stream by introducing such a stream into the reactor in admixture with the fresh feedstock or between catalyst beds may accordingly be desirable. Reaction zone 1 also includes heat exchange means, pumping means, instrumentation, etc., all known in the art. Reactions occurring in reaction zone 1 take place at a temperature of about 300° F. to about 700° F. in a preferably liquid phase, thereby requiring a pressure of about 20 to about 60 atmospheres. About 0.1 to about 50 volumes of catalyst are required per volume of fresh feedstock.

Effluent is withdrawn from reaction zone 1 via conduit 4 and introduced into separation zone 5, wherein by fractionation means not shown the gasoline product of the inventive process may be stabilized and rerun as necessary to remove light ends and any product higher in molecular weight than desired to meet gasoline specification. For a feedstock boiling within a suitable gasoline range, neither stabilization nor returning of the reaction zone effluent are necessarily required by the present inventive process, but in the case that the feedstock contains heavier molecules boiling above the desired gasoline end point, rerunning may in a particular application of the process be desirable, and it may be further desirable to recycle a portion of the heavier molecular weight product boiling above the gasoline boiling range by conduit 3 as described hereinbefore. As shown in the drawing, light ends are withdrawn from separation zone 5 via conduit 6; gasoline product is withdrawn via conduit 7; and higher boiling product is withdrawn via conduits 3 and 8. Separation zone 5 includes separation means such as fractionation vessels, receiving vessels, fractionation trays, pumping means, heat exchange means, instrumentation, etc., all known in the art. The use and placement of such conventional items will be obvious to those skilled in the art.

DETAILED DESCRIPTION OF THE INVENTION

In the process of the present invention, a principally straight-chain, mono-olefinic, low octane feedstock is reacted and converted into a principally branched-chain, mono-olefinic, high octane product. A typical feedstock has a boiling range between about 110° F. and 480° F. and includes molecules containing from 5 to 14 carbon atoms. A $C_7$ to $C_{12}$ feedstock would be especially suited to take advantage of the isomerization reactions taking place in the present process, while addition of $C_{13}$ and $C_{14}$ molecules lends itself to cracking of the latter stated molecules and polymerization of the products to result in a net product richer in $C_5$ to $C_{12}$ molecules than the feedstock. $C_3$ and $C_4$ mono-olefins may also be advantageously included in the feedstock to obtain high octane polymerization products in the gasoline boiling range of about 100° F. to about 400° F.

Although a suitable mono-olefinic feedstock may be prepared as a product stream from wax cracking operations, from tri-ethyl aluminum catalyzed linear olefin systems, and from other processing techniques known in the art, the instant process is especially suitable to process the gasoline product derived from a Fischer-Tropsch synthesis reaction. A typical Fischer-Tropsch gasoline boiling-range product with an end point of about 400° F. as synthesized by contact with an iron catalyst preferred in present-day operations consists of about 70 to 90 volume percent olefins, about 50 to 80 volume percent of which are straight-chain mono-olefins. By carbon olefin content of a particular Fischer-Tropsch gasoline normally varies between about 80 and 85 volume percent while the straight chain portion of the olefins generally decreases as carbon number increases from about 85 volume percent straight-chain olefin in the $C_5$ fraction. Apart from the olefin content, a Fischer-Tropsch gasoline contains principally paraffins, with normal paraffins comprising a major portion of the paraffin fraction, a lesser amount of aromatics, oxygenated compounds, and a relatively small quantity of diolefins. Oxygenated compounds when contacted with the catalyst of the present invention are largely reacted to form hydrocarbon and water products, the latter of which is beneficial to the present catalyst when the water formed is not in excess of about 500 ppm. based on total hydrocarbon introduced into a catalyst bed. Should oxygenated compounds or diolefins be present in a synthetic gasoline in amount to be detrimental to the catalyst or process equipment, treatment of the synthetic gasoline prior to its introduction into the present process by means known in the art becomes required.

$C_3$ and $C_4$ olefinic fractions suitable as feed in admixture with the $C_5$ to $C_{14}$ feedstock described hereinabove are readily available from many processing operations such as fluid catalytic cracking, thermal cracking for olefins (pyrolysis), and others. $C_3$ and $C_4$ olefins prepared in a Fischer-Tropsch hydrocarbon synthesis reaction are especially preferred because of their ready availability to a processor who has a Fischer-Tropsch synthetic gasoline available. While essentially pure $C_3$ and $C_4$ olefin feed streams are suitable, normally $C_3$ and $C_4$ olefins are prepared in admixture with $C_3$ and $C_4$ paraffins by the above mentioned processes, and in admixture of olefins and paraffins is in fact preferred as a feed due to a preferred mode of operation wherein the paraffins serve to absorb the heat of reaction evolved in the polymerization reaction of the $C_3$ and $C_4$ olefins. $C_3$ or $C_4$ olefin-containing streams separately or an admixture of $C_3$'s and $C_4$'s are suitable.

The present invention is directed solely to a process wherein a solid phosphoric acid catalyst is utilized. The solid phosphoric acid catalysts which may be utilized in the method of the present invention may be prepared by mixing an acid of phosphorous, such as ortho-, pyro-, or tetra-phosphoric acid and a finely divided, generally siliceous, solid carrier (such as diatomaceous earth, prepared forms of silica, reactivated clays, and the like) to form a wet paste. The paste is then calcined at temperatures generally below about 500° F. to produce a solid cake which is thereafter ground and sized to produce particles of usable mesh. If the calcination is carried out at temperatures above about 400° F., it may be desirable to rehydrate the catalyst granules at a temperature between about 200° C. and 350° C., typically 260° C., to produce an acid composition corresponding to high catalytic activity. The catalyst preparation procedure may be varied by forming particles of the original paste by extrusion or by pelleting methods after which the formed particles are calcined and, if necessary, rehydrated. A solid phosphoric acid catalyst prepared from a major proportion by weight of a phosphoric acid having at least as large a water content as that of the pyro-acid and a minor proportion of the siliceous carrier, such as kieselguhr, is preferred for use in the present process. In a preferred embodiment of the present invention, the catalyst includes about 60 to 90 percent by weight phosphoric acid. Further descriptions of procedures to manufacture satisfactory solid phosphoric acid catalysts are available in U.S. Pat. No. 1,993,513 and U.S. Pat. No. 3,673,111.

Suitable reactors in the present invention include radial, chamber, or pipe reactors, the latter of which consists of a plurality of vertical tubes in parallel flow through which the reactants pass. Catalyst may be loaded in a chamber reactor in a single bed or a plurality of beds in series, while in the pipe reactor catalyst is placed within the tubes, which are placed within a reactor vessel. Direction of flow may be upwardly, downwardly or radially. Especially preferred is a chamber reactor containing one to six catalyst beds placed in a manner to facilitate catalyst unloading and redistribution of reactants within the reactor. Should heat of reaction be excessive in a particular installation, quenching means may be provided to introduce a relatively inert quenching stream containing, for example, propane or butane, between beds of a multi-bed chamber reactor. While quenching of the reaction by introducing a quenching stream between beds may be desired, it is frequently also necessary to provide sufficient non-reactive components in the feed to the reactor to absorb a large portion of the heat of reaction.

A predominantly liquid phase operation within the reactor is preferred. At reaction temperature of about 300° F. to 700° F., a pressure of about 20 to about 60 atmospheres is thereby required to maintain the reactants and reaction products principally in liquid phase. Especially preferred is a reaction temperature of about 350° F. to 550° F. Based on total feed to the reactor, 0.1 to 50 volumes/hour of feed per volume of catalyst may be processed, with a preferred total feed rate of about 0.5 to 5 volumes/hour per volume of catalyst.

An isomerization reaction to rearrange the molecular structure of the $C_5$ to $C_{12}$ straight-chain mono-olefins present in the feedstock is the primary reaction taking place within the instant process and results in a principally branched-chain mono-olefinic product. The net effect is an improvement in research method octane number from about 60 to 65 in the feedstock to about 80 to 90 in the product. The phosphoric acid catalyst utilized also has the capability of cracking heavier components of the feedstock, therefore in a preferred mode of operation, $C_{13}$ and $C_{14}$ products of the Fischer-Tropsch reaction are also reacted resulting in additional formation of branched-chain $C_5$–$C_{12}$ olefins. It is believed that the mechanism of this conversion consists of a first reaction to crack a heavier olefin followed by a polymerization reaction of the first reaction products to form a branched-chain $C_5$–$C_{12}$ molcule. The phosphoric acid catalyst is well-known in the art as a highly effective polymerization catalyst and is utilized as such in a preferred mode of operation by introducing $C_3$ and $C_4$ olefins into the process in admixture with the $C_5$ to $C_{14}$ olefinic feedstock. An important benefit of the present inventive process is that a $C_3$ to $C_{14}$ product fraction of a Fischer-Tropsch reaction may be upgraded to a high octane gasoline blending component by contacting it, without prior separation, with a single catalyst which has the capability to polymerize the lighter components ($C_3$ and $C_4$), to isomerize the usual gasoline components ($C_5$ to $C_{12}$), and to crack the heavier components ($C_{13}$ and $C_{14}$). Another important advantage is that the stated reactions all take place in the process at moderate severity of temperature and pressure and without a need for a hydrogen atmosphere. A further advantage is the increase in gasoline boiling range product of a Fischer-Tropsch reaction by cracking higher boiling molecules to the gasoline boiling range.

To maintain suitable activity and stability, the solid phosphoric acid catalyst must be maintained at a predetermined level of hydration. This is usually accomplished by close control of the water content of the hydrocarbon feedstock introduced into the catalyst bed, about 100 to 1000 ppm. water being preferred in the feedstock to achieve optimal activity and stability. Oxygenated compounds, which normally comprise about 0.1 to 10 percent of a Fischer-Tropsch synthetic gasoline, react when in contact with a phosphoric acid catalyst at the operating conditions of the present process to form hydrocarbon and water; therefore, addition of free water into the present process is not required unless the Fischer-Tropsch gasoline is pretreated to remove oxygenated compounds. Because excessive water has a detrimental effect on the catalyst, and may in combination with the phosphoric acid catalyst result in corrosion of the process equipment, treating of the synthetic gasoline feedstock may be necessary to reduce its oxygen content.

In addition to a reactor and its catalyst loading, a reaction zone of the present process includes pumping means, heat exchange means, heaters, instruments, and other process equipment known in the art. Reactor effluent is cooled and is passed into a separation zone comprising fractionators, separating vessels, heating and heat exchange means, pumping means, etc., all known in the art. In an embodiment wherein a $C_5$ to $C_{12}$ feedstock is introduced into the reaction zone, the separation zone need only stabilize the reaction zone effluent to result in a predetermined vapor pressure of the gasoline product. Whenever a reactant stream containing $C_3$ and $C_4$ olefins and paraffins is also charged to the reaction zone, stabilization is required to remove butane and lighter molecules, but recycling facilities may also be provided to return a portion of the propane and butane separated from the gasoline product to the reaction zone as a quenching stream, which may be either admixed with the feed to the reactor or introduced into the reactor between catalyst beds. Whenever a $C_{13}$ to $C_{15}$ fraction is also included with the $C_5$ to $C_{12}$ feed to the reaction zone, returning of the stabilized product liquid is preferred to separate hydrocarbons boiling above the gasoline boiling range, i.e., above about 400° F. In a preferred embodiment, at least a portion of the thus separated reaction zone effluent boiling over about 400° F. is recycled and admixed with the feed to the reaction zone to further crack this relatively high boiling stream, thereby resulting in a higher yield of product in the gasoline boiling range and a lower yield of product boiling higher than gasoline.

The following working examples are given to illustrate further the use of a phosphoric acid catalyst to increase the octane number of suitable hydrocarbon products of a Fischer-Tropsch synthesis reaction. It is understood that the examples are intended to be illustrative rather than restrictive.

EXAMPLE I

A portion of a commercial solid phosphoric acid catalyst containing about 65 weight percent phosphoric acid and about 35 weight percent kieselguhr is loaded into a continuous, fixed bed gasoline plant comprising a reaction section and a fractionation section. In this plant, a Fischer-Tropsch synthesized gasoline is continuously contacted with the catalyst at the following conditions; 1.0 pound/hour of gasoline feed per pound of catalyst, a pressure of 600 psig., and a reactor inlet temperature of 480° F.

The synthetic gasoline feed has a specific gravity of 0.749 at 60° F., a research method octane number of 63, an initial boiling point of 110° F., a 50 percent boiling point of 330° F., and an end point of 480° F. Seventy-eight weight percent of this synthetic gasoline boils below 400° F., and the remainder boils higher than 400° F.

The gasoline plant is made up of a reactor containing solid phosphoric acid catalyst particles in four equivalent catalyst beds in series, a rerun column, and suitable heating, pumping, cooling, and controlling means. The feedstock, after heating to the reactor inlet temperature, is passed downflow through the reactor. The resulting reactor effluent stream is cooled and passed into the rerun column wherein an overhead gasoline product fraction boiling below 400° F. and a bottoms product fraction boiling over 400° F. are separated.

In this example, the gasoline boiling range product has a density of 61° API or a specific gravity of 0.735 at 60° F., a research method octane number of 82, an initial boiling point of 100° F., a 50 percent boiling point of 290° F., and an end point of 400° F. Forty-seven weight percent of the feed boiling over 400° F. is converted to product boiling below 400° F., therefor the yield of 400° F. end point gasoline product has been increased 13.4 weight percent compared to the feedstock.

EXAMPLE II

The feedstock of Example I in admixture with a portion of a $C_3/C_4$ principally olefinic product of a Fischer-Tropsch synthesis reaction and a $C_3/C_4$ principally paraffinic recycle stream described hereinbelow is passed over the same catalyst of the previous example at the following conditions: 1.0 pound/hour of total feed to the reactor per pound of catalyst, a pressure of 600 psig., and a reactor inlet temperature of 360° F.

The combined feedstock to the reactor is distributed as follows in weight percent of the total:

| | Combined Feed, Wt. Percent | | |
|---|---|---|---|
| | Liquid As Per Example I | $C_3/C_4$ Feed | $C_3/C_4$ Recycle |
| Propylene | — | 18.8 | 1.3 |
| Propane | — | 1.9 | 17.5 |
| Butylene | — | 15.1 | 1.9 |
| Butane | — | 1.9 | 17.0 |
| Liquid Fraction | 24.6 | 0 | 0 |
| TOTAL | 24.6 | 37.7 | 37.7 |

The gasoline plant of the present example, in addition to the equipment of Example I, includes a debutanizer column downstream of the reactor and upstream of the rerun column. The combined feed, comprising the three streams described hereinabove, is heated to the reactor inlet temperature and passed downflow through four serial catalyst beds in a chamber reactor. The reactor effluent stream is cooled and introduced into the debutanizer wherein a butane and lighter overhead fraction and a debutanized bottom fraction are separated. A portion of the debutanizer overhead fraction is recycled to form the $C_3/C_4$ recycle stream introduced as part of the reactor combined feed, and a second portion is withdrawn from the process as a product stream. The debutanizer bottom fraction is introduced into the rerun column wherein an overhead gasoline fraction boiling below 400° F. and a bottoms fraction boiling over 400° F. are separated and also withdrawn as product streams.

The 400° F. end point gasoline product of the process of this example has a specific gravity of 0.739 at 60° F. and a research method octane number of 89. Cracking of the portion of the feedstock boiling over 400° F. is 33.5 weight percent while polymerization of propylene and butylene in the feedstock to gasoline boiling range product is 90 weight percent. The overall increase in 400° F. end point gasoline as compared to the feed is 122.5 weight percent.

I claim as my invention:

1. A process for improving low octane number gasoline synthesized from carbon monoxide and hydrogen, having an initial boiling point of about 110° F. and an end boiling point of about 480° F. and containing straight-chain olefins of from 5 to 14 carbon atoms per molecule, which process comprises contacting said gasoline with a solid phosphoric acid catalyst at a temperature of from about 300° F. to about 700° F., a pressure of from about 20 to about 60 atmospheres and a rate of feed of 0.1 to 50 volumes/hour of gasoline per volume of catalyst, and recovering the resultant higher octane olefin-containing hydrocarbon product.

2. The process of claim 1 wherein said gasoline includes oxygenated compounds containing 0.1 to 10 percent by weight oxygen.

3. The process of claim 1 wherein said gasoline includes about 70 to 90 percent by weight olefins.

4. The process of claim 1 wherein said solid phosphoric acid catalyst contains about 60 to 90 percent by weight phosphoric acid.

5. The process of claim 1 wherein said hydrocarbon product is separated to form a gasoline product having an end point of about 400° F. and a higher boiling product; and at least a portion of said higher boiling product is recontacted with said catalyst.

6. The process of claim 1 wherein $C_3$ and $C_4$ olefinic hydrocarbons and said hydrocarbon fraction are contacted in admixture with said catalyst.

7. The process of claim 6 wherein propane and butane are simultaneously contacted with said catalyst to absorb heat of reaction.

* * * * *